US008113879B1

(12) United States Patent
Zraik

(10) Patent No.: US 8,113,879 B1
(45) Date of Patent: Feb. 14, 2012

(54) ONE-PIECE COMPRESSION CONNECTOR BODY FOR COAXIAL CABLE CONNECTOR

(75) Inventor: Souheil Zraik, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/843,971

(22) Filed: Jul. 27, 2010

(51) Int. Cl.
*H01R 9/05* (2006.01)

(52) U.S. Cl. ..... 439/584; 439/578

(58) Field of Classification Search ..... 439/578, 439/584, 585
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,348,186 | A | 10/1967 | Rosen |
| 3,350,677 | A | 10/1967 | Daum |
| 3,355,698 | A | 11/1967 | Keller |

(Continued)

FOREIGN PATENT DOCUMENTS

CA 2096710 A1 11/1994

(Continued)

OTHER PUBLICATIONS

Digicon AVL Connector. Arris Group Inc. [online]. 3 pages [retrieved on Apr. 22, 2010]. Retrieved from the Internet< URL: http://www.arrisi.com/special/digiconAVL.asp>.

(Continued)

*Primary Examiner* — Thanh Tam Le
(74) *Attorney, Agent, or Firm* — Schmeiser Olsen & Watts

(57) ABSTRACT

A connector for mounting to the terminal end of a coaxial cable includes a connector body having a first body section and a second axially adjacent body section. The first and second body sections are frangibly connected to one another wherein axial compressive force upon the second body section towards the first body section causes the second body section to fracture and be displaced axially over the exterior of the first body section. As such, the second body section is a compression sleeve which when so moved radially compresses at least a portion of the first body section of the connector body to permit compression of a prepared coaxial cable end.

8 Claims, 5 Drawing Sheets

U.S. PATENT DOCUMENTS

| | | | |
|---|---|---|---|
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,710,005 | A | 1/1973 | French |
| 3,739,076 | A | 6/1973 | Schwartz |
| 3,744,007 | A | 7/1973 | Horak |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,296,986 | A | 10/1981 | Herrmann, Jr. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |

4,761,146 A 8/1988 Sohoel
4,772,222 A 9/1988 Laudig et al.
4,789,355 A 12/1988 Lee
4,806,116 A 2/1989 Ackerman
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,971,727 A 11/1990 Takahashi et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,093 A 7/1993 Cole et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,359,735 A 11/1994 Stockwell
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,464,661 A 11/1995 Lein et al.
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hse
5,696,196 A 12/1997 DiLeo
5,702,263 A 12/1997 Baumann et al.
5,722,856 A 3/1998 Fuchs et al.
5,746,617 A 5/1998 Porter, Jr. et al.
5,746,619 A 5/1998 Harting et al.
5,769,652 A 6/1998 Wider
5,770,216 A 6/1998 Mitchnick et al.
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,949,029 A 9/1999 Crotzer et al.
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,089,903 A 7/2000 Stafford Gray et al.
6,089,912 A 7/2000 Tallis et al.

| | | | | |
|---|---|---|---|---|
| 6,089,913 | A | 7/2000 | Holliday | |
| 6,117,539 | A | 9/2000 | Crotzer et al. | |
| 6,123,567 | A | 9/2000 | McCarthy | |
| 6,146,197 | A | 11/2000 | Holliday et al. | |
| 6,152,753 | A | 11/2000 | Johnson et al. | |
| 6,153,830 | A | 11/2000 | Montena | |
| 6,180,221 | B1 | 1/2001 | Crotzer et al. | |
| 6,210,222 | B1 | 4/2001 | Langham et al. | |
| 6,217,383 | B1 | 4/2001 | Holland et al. | |
| 6,239,359 | B1 | 5/2001 | Lilienthal, II et al. | |
| 6,241,553 | B1 | 6/2001 | Hsia | |
| 6,261,126 | B1 | 7/2001 | Stirling | |
| 6,271,464 | B1 | 8/2001 | Cunningham | |
| 6,331,123 | B1 | 12/2001 | Rodrigues | |
| 6,332,815 | B1 | 12/2001 | Bruce | |
| 6,358,077 | B1 | 3/2002 | Young | |
| 6,375,866 | B1 | 4/2002 | Paneccasio, Jr. et al. | |
| D458,904 | S | 6/2002 | Montena | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,416,847 | B1 | 7/2002 | Lein et al. | |
| 6,422,900 | B1 | 7/2002 | Hogan | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| 6,465,550 | B1 | 10/2002 | Kleyer et al. | |
| 6,468,100 | B1 | 10/2002 | Meyer et al. | |
| 6,491,546 | B1 | 12/2002 | Perry | |
| D468,696 | S | 1/2003 | Montena | |
| 6,506,083 | B1 | 1/2003 | Bickford et al. | |
| 6,530,807 | B2 | 3/2003 | Rodrigues et al. | |
| 6,540,531 | B2 | 4/2003 | Syed et al. | |
| 6,558,194 | B2 | 5/2003 | Montena | |
| 6,572,419 | B2 | 6/2003 | Feye-Homann | |
| 6,576,833 | B2 | 6/2003 | Covaro et al. | |
| 6,619,876 | B2 | 9/2003 | Vaitkus et al. | |
| 6,676,446 | B2 | 1/2004 | Montena | |
| 6,683,253 | B1 | 1/2004 | Lee | |
| 6,692,285 | B2 | 2/2004 | Islam | |
| 6,712,631 | B1 | 3/2004 | Youtsey | |
| 6,716,062 | B1 | 4/2004 | Palinkas et al. | |
| 6,733,337 | B2 | 5/2004 | Kodaira | |
| 6,767,248 | B1 | 7/2004 | Hung | |
| 6,780,052 | B2 | 8/2004 | Montena et al. | |
| 6,786,767 | B1 | 9/2004 | Fuks et al. | |
| 6,790,081 | B2 | 9/2004 | Burris et al. | |
| 6,805,584 | B1 | 10/2004 | Chen | |
| 6,817,896 | B2 | 11/2004 | Derenthal | |
| 6,848,939 | B2 | 2/2005 | Stirling | |
| 6,848,940 | B2 | 2/2005 | Montena | |
| 6,884,115 | B2 | 4/2005 | Malloy | |
| 6,887,103 | B2 * | 5/2005 | Montena et al. | 439/583 |
| 6,939,169 | B2 | 9/2005 | Islam et al. | |
| 6,971,912 | B2 | 12/2005 | Montena et al. | |
| 7,026,382 | B2 | 4/2006 | Akiba et al. | |
| 7,029,326 | B2 | 4/2006 | Montena | |
| 7,086,897 | B2 | 8/2006 | Montena | |
| 7,097,499 | B1 | 8/2006 | Purdy | |
| 7,114,990 | B2 | 10/2006 | Bence et al. | |
| 7,118,416 | B2 | 10/2006 | Montena et al. | |
| 7,125,283 | B1 * | 10/2006 | Lin | 439/578 |
| 7,147,509 | B1 | 12/2006 | Burris et al. | |
| 7,229,303 | B2 | 6/2007 | Vermoesen et al. | |
| 7,252,546 | B1 | 8/2007 | Holland et al. | |
| 7,255,598 | B2 | 8/2007 | Montena et al. | |
| 7,364,462 | B2 * | 4/2008 | Holland | 439/584 |
| 7,393,245 | B2 | 7/2008 | Palinkas et al. | |
| 7,404,737 | B1 * | 7/2008 | Youtsey | 439/578 |
| 7,476,127 | B1 | 1/2009 | Wei | |
| 7,479,035 | B2 | 1/2009 | Bence et al. | |
| 7,497,729 | B1 | 3/2009 | Wei | |
| 7,507,116 | B2 * | 3/2009 | Laerke et al. | 439/584 |
| 7,507,117 | B2 | 3/2009 | Amidon | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,794,275 | B2 | 9/2010 | Rodrigues | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 * | 12/2010 | Wei | 439/578 |
| 7,857,661 | B1 | 12/2010 | Islam | |
| 7,874,870 | B1 | 1/2011 | Chen | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2004/0018312 | A1 | 1/2004 | Halladay | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0109994 | A1 | 5/2005 | Matheson et al. | |
| 2005/0208827 | A1 | 9/2005 | Burris et al. | |
| 2006/0110977 | A1 | 5/2006 | Matthews | |
| 2006/0154519 | A1 | 7/2006 | Montena | |
| 2007/0026734 | A1 | 2/2007 | Bence et al. | |
| 2007/0077360 | A1 | 4/2007 | Kashiwagi et al. | |
| 2008/0102696 | A1 | 5/2008 | Montena | |
| 2009/0029590 | A1 | 1/2009 | Sykes et al. | |
| 2009/0098770 | A1 | 4/2009 | Bence et al. | |
| 2010/0081321 | A1 | 4/2010 | Malloy et al. | |
| 2010/0081322 | A1 | 4/2010 | Malloy et al. | |
| 2010/0239871 | A1 | 9/2010 | Scheffer et al. | |
| 2010/0255721 | A1 | 10/2010 | Purdy et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |

| | | | |
|---|---|---|---|
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

OTHER PUBLICATIONS

U.S. Appl. No. 13/072,350, filed Mar. 25, 2011.
U.S. Appl. No. 13/072,605, filed Mar. 25, 2011.
U.S. Appl. No. 13/213,954, filed Aug. 19, 2011.

* cited by examiner

ONE-PIECE COMPRESSION CONNECTOR BODY FOR COAXIAL CABLE CONNECTOR

FIELD OF THE INVENTION

The application relates generally to the field of coaxial-type cable connectors and more specifically to a coaxial cable compression connector for terminating a prepared coaxial cable end in which a compression member is integrally provided as part of the connector body.

BACKGROUND OF THE INVENTION

Coaxial cable connectors are commonly used with a terminated coaxial cable end for connection to various components, such as those in CATV and broadband applications including attachment to appliances such as computers, televisions and the like. The terminal end of a coaxial cable is typically retained by means of a compression member acting in concert with a connector body into which the cable end is introduced.

One common type of coaxial cable connector useful for the above purposes is defined by a number of elements that include a hollow post, a coupling nut, a connector body and a compression sleeve or other member. A typical example of such a connector is described in commonly owned and assigned U.S. Pat. No. 6,716,062. The connector body, post and compression sleeve according to this typical design are individual and separate components that permit the end of a coaxial cable to be secured and wherein the nut is connected to the flanged end of the post and is freely rotatable to permit attachment, for example, to an external port, such as found on an appliance.

According to this version, the connector body is acted upon by the compression sleeve which is axially displaced over the exterior of the connector body. The compression sleeve is defined by an axial section having an inner diameter that is smaller than the exterior diameter of the connector body to effect radial deformation thereof and produce retention of the prepared cable end.

There is a general need to facilitate the manufacturability of the above-noted connectors. To that end, one attempt at integrating the connector body and compressive sleeve is described in commonly owned U.S. Pat. No. 6,780,052 B2. Two embodiments are described in this patent. According to a first embodiment, a proximal portion of the connector body is caused to fracture wherein the fractured portion is further caused to move inwardly within the connector body as a wedge. In a second embodiment, the connector body or at least a portion thereof is made from a highly flexible material that is readily deformable. As axial force is applied, a portion of the connector body is then caused to fold upon itself to create a retaining chamber. Another attempt at integration of a compressive member in a coaxial cable connector is described in U.S. Pat. No. 7,125,283. This latter patent still requires the use of separate components, including an exterior sleeve as well as an independent locking ring.

Each of the foregoing patents provide techniques for creating compression in order to retain a prepared coaxial cable end for termination, but involve variations to those previously employed when separate components are used. It would be preferred to simplify the design of currently known compression connectors of the above type, while still reliably providing the same form of cable compression technique.

SUMMARY OF THE INVENTION

According to one aspect, there is provided a connector body for a coaxial cable connector, said connector body being defined by a hollow member having opposing ends, said connector body including a first body section and an axially adjacent second body section, said first body section being radially deformable, wherein compressive axial force applied upon said second end of said connector body causes said second body section to fracture relative to said first body section, said second body section being caused to move over the exterior surface of said first body section and form a compression sleeve.

In one version, the interior surface of the first body section includes an inwardly ramped surface wherein movement of the first body section over the second body section causes radial deformation of the first body section to permit retention of an installed cable end.

In one version, a weakened or frangible area is created between the first and second body sections that is caused to fracture upon application of the axial force, thereby allowing the movement of the second body section over the exterior of the first body section.

According to another aspect, there is provided a coaxial cable connector comprising a coupling nut, a hollow post having a first end and a second end, said second end being configured for engaging the end of a coaxial cable end, and a connector body being defined by a hollow plastic member having opposing ends, said connector body including a first body section and an axially adjacent second body section wherein said second end of said hollow post is disposed within the first body section of said connector body, said first body section being radially deformable, wherein a compressive axial force applied upon said second end of said connector body causes said second body section to fracture relative to said first body section, said second body section being caused to move over the exterior surface of said first body section and form a compression sleeve.

In one version, the first and second body sections are separated by a weakened or frangible annular portion that is caused to fracture upon application of axial force upon said second body section, thereby allowing movement of the second body section over the exterior surface of the first body section.

The second body section can include an interior area tapering from a first inner diameter to a second smaller inner diameter such that axial movement of the second body section over the exterior surface of the first body section causes radial deformation thereof. At least a portion of the first body section can include a thin-walled cylindrical chamber made from a deformable material.

An advantage of the herein described connector is that the connector operates in substantially the same manner as previously known compression-type connectors, but with fewer components.

Another advantage realized herein is that the presently described connector provides cost reduction through conversion of a separately molded or fabricated part to a molded part of the connector body with no substantial impact on reliability.

These and other features and advantages will be readily apparent from the following Detailed Description, which should be read in conjunction with the accompanying drawings.

DETAILED DESCRIPTION

The following description relates to a preferred embodiment of a compression-type coaxial cable connector. More specifically, the herein described connector relates to a specific version of an F-type or F-connector, but it will be readily apparent that the herein described connector body with an incorporated or integrated compression ring or sleeve can be incorporated into other suitable compression-type connector designs, such as but not limited to, F-Type, RCA and BNC-type connectors. In addition, various terms are used throughout, such as "top", "bottom", "upper", "lower" and the like in order to provide a suitable frame of reference with regard to the accompanying drawings. These conventions, however, are not intended to overly burden the intended scope of the herein described concepts, except in those instances where so specifically noted.

Figure 1:
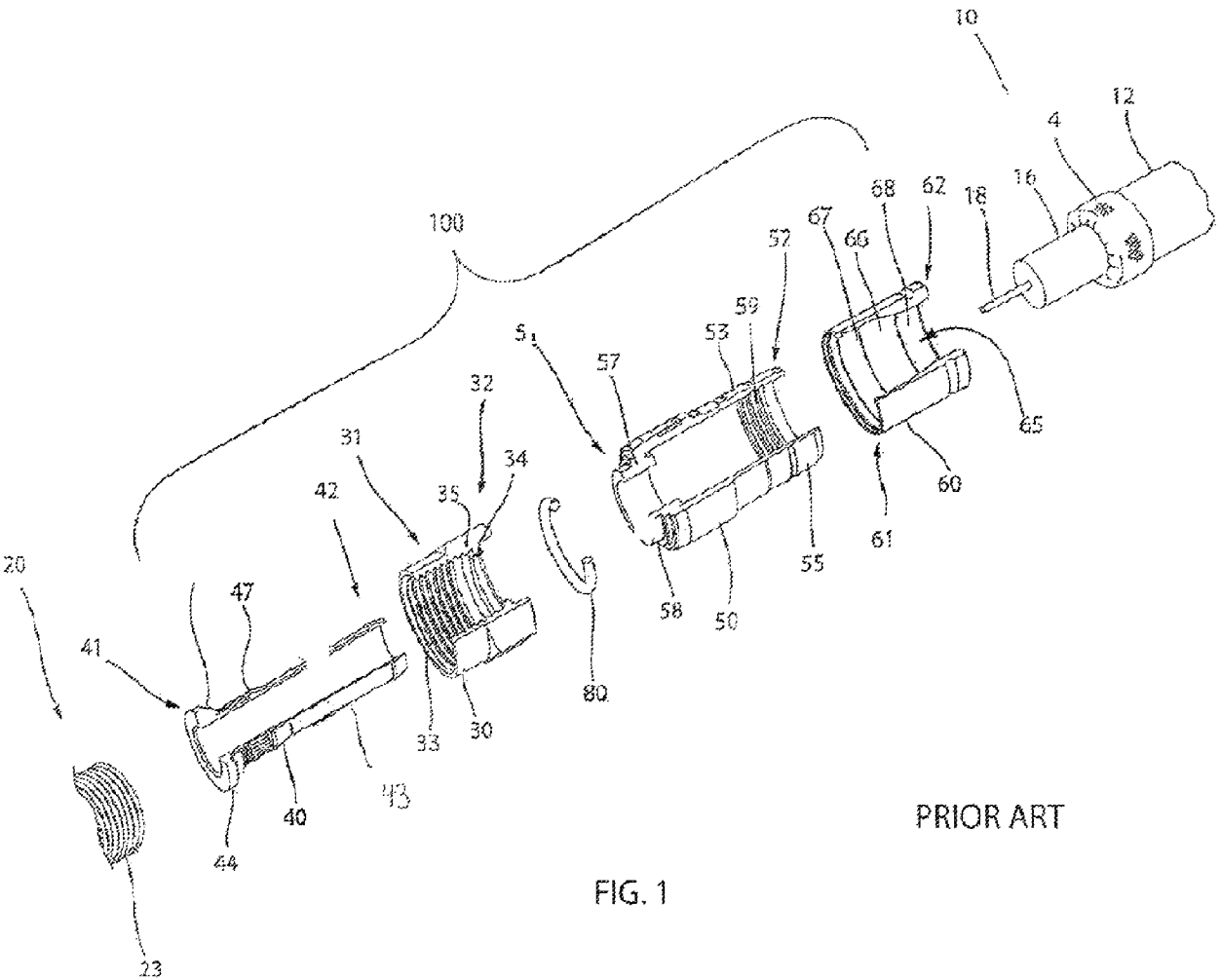
PRIOR ART FIG. 1
FIG. 1 is an exploded assembly view of a prior art coaxial cable connector.
Figure 2:
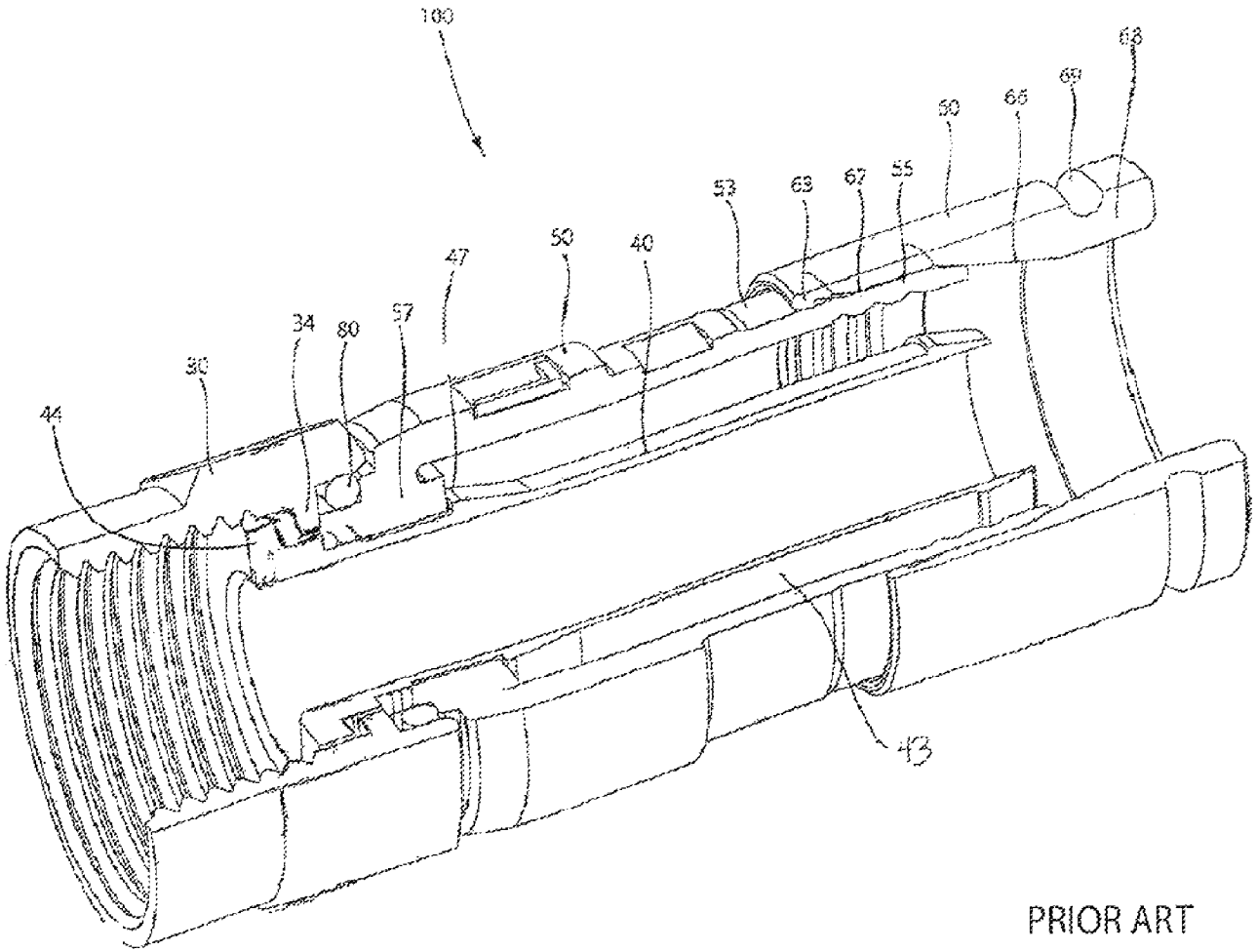
PRIOR ART FIG. 2
FIG. 2 is a side elevational view, taken in section, of the coaxial cable connector of FIG. 1, in an assembled condition.
Figure 3:
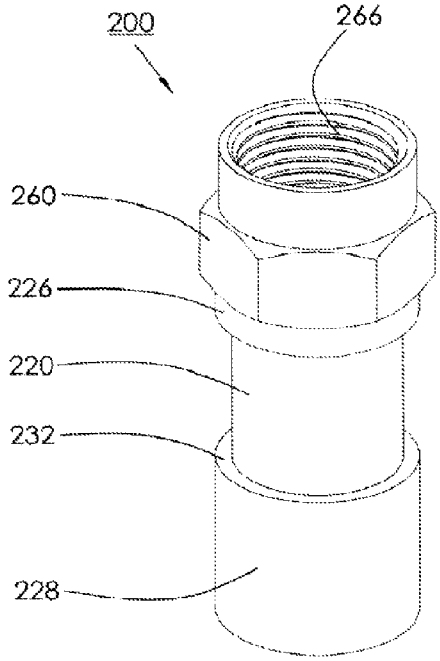
FIG. 3 is a side perspective view of a coaxial cable connector in accordance with an exemplary embodiment of the present invention.
Figure 4:
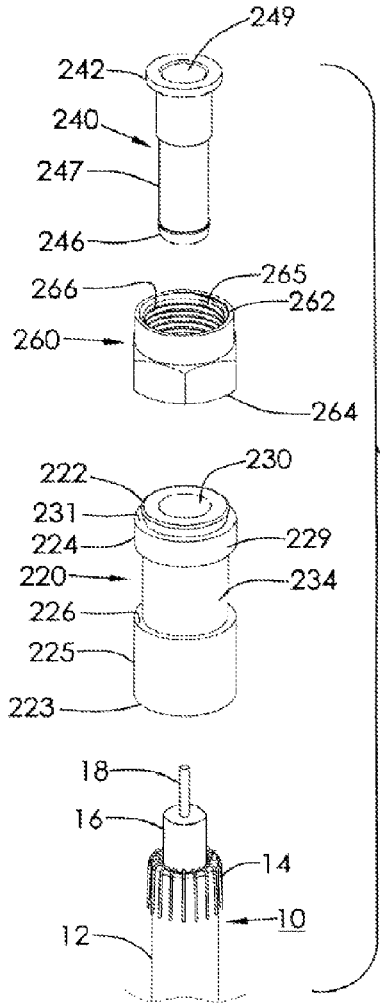
FIG. 4 is an exploded view of the coaxial cable connector of FIG. 3.

Reference is first made to FIGS. 1 and 2 that depict a prior art compression connector, described herein for background purposes.

This coaxial cable connector is shown in FIG. 1 in exploded form. The connector, hereinafter labeled with reference numeral 100, is defined by an assemblage having a number of discrete components that can be operably affixed to the end of a coaxial cable 10, the cable having a protective outer jacket or sleeve 12, a conductive grounding shield 14, an interior or intermediate dielectric layer 16 and a center conductor 18. The coaxial cable 10 can be drawn back for purposes of termination, as represented in FIG. 1, by removing the protective outer jacket 12 and then drawing back the conductive grounding shield 14, which may be braided, in order to expose an axial portion of the intermediate dielectric layer 16. Additional preparation of the end of the coaxial cable 10 can include stripping or coring the intermediate dielectric layer 16 in order to expose a portion of the center conductor 18.

The components, for purposes of this typical connector 100, include a threaded nut 30, a post 40, a connector body 50, a compression member or sleeve 60 and a connector body sealing member 80, such as an O-ring.

A brief description of each of the components of the connector of FIGS. 1 and 2 now follows: First, the threaded nut 30 according to this version is formed from an electrically conductive material, the nut having a first end 31 and an opposing second end 32. A set of internal threads 33 extend from the edge of the first end 31 over a sufficient axial distance that permits effective threaded contact with the external threads 23 of a standard coaxial cable interface port 20 (shown partially in FIG. 1). The nut 30 further includes an internal lip 34, in this instance an annular protrusion, which is disposed proximate the second end 32, therein defining a flange.

The post 40 is a rigidly formed body made according to this version from an electrically conductive material and defined by a first end 41 and an opposing second end 42. A flange 44, such as an externally extending annular protrusion, is located at the first end 41 of the post 40 and defined by an annular shoulder 45. The post 40 further includes a hollow shaft portion 43 having a substantially constant and cylindrical cross section extending from the second end 42 to a tapering portion having at least one surface feature 47 that is intermediately disposed in relation to the first end 41. When assembled, the post 40 is formed such that portions of the prepared coaxial cable end 10, including the intermediate dielectric layer 16 and the center conductor 18, are permitted to pass into the second end 42 through the shaft portion 43 while the outer jacket 12 and shielding layer 14 are caused to be stripped by the second end of the post, as described briefly below.

The connector body 50 includes a first end 51 and an opposing second end 52 that is substantially hollow and defined by a center passageway or bore. Adjacent the first end 51 of the connector body 50 is a post mounting portion 57 that is configured to mate with the at least one exterior surface feature 47 of the post 40, enabling the post to be axially as well as radially secured to the connector body. The connector body 50 further includes an outer annular recess 58 located proximate the first end 51, which enables the placement of the sealing member 80 as further confined by the second end 32 of the nut 30 proximal to the lip 34. A portion 53 of the connector body 50 is formed from a semi-rigid, yet compliant outer surface 55, this portion being configured to form an annular seal when the second end 52 is deformably compressed against a retained coaxial cable 10 by operation of the compression member 60, as described in greater detail below.

The compression member 60 according to this known connector version is defined by a cylindrical sleeve-like section that further includes opposing first and second ends 61, 62, respectively. The first and second ends 61, 62 are interconnected by means of a center passageway 65, the passageway having a plurality of sections including a first diametrical section 67 adjacent the first end 61 having a first inner diameter and a second diametrical section 68 adjacent the second end 62 having a second inner diameter that is smaller than the first inner diameter. A transitional section 66, provided intermediate the first and second diametrical sections 67, 68, is defined by an interior ramped surface.

The herein described coaxial cable connector 10, referring to FIGS. 1 and 2, serves to securably retain a prepared coaxial cable end 10 (the cable is not shown in FIG. 2 for the sake of clarity). In this configuration, the prepared coaxial cable end 10, including the extending axial section of the center conductor 18, is inserted into the interior of the connector body 50 through the second end 52 thereof as well as through the center passageway 65 of the compression member 60. The first end 42 of the post 40, fitted and secured into the confines of the connector body 50 engages the coaxial cable end 10 between the cored dielectric layer 16 and the grounding shield layer 14. According to this version, the compression member 60 is then axially advanced over the exterior of the connector body 50 by means of a compression tool (not shown) or otherwise, causing the interior ramped surface of the compression member 60 to engage and thereby compress the deformable outer portion 53 of the connector body 50 in a radial fashion inwardly and securing the coaxial cable end 10 within the connector 100. The dielectric layer 16 and center conductor 18 are each advanced into the shaft portion 43 of the post 40, while the outer sleeve 12 and the shielding layer 14 of the advanced coaxial cable 10 are additionally stripped by means of the post 40 and the action of the compression tool and the advancing compression member 60, which passes axially over the exterior of the connector body 50.

As noted, the post 40 is secured with the connector body 50 wherein the at least one exterior surface feature 47 of the post engages with the post mounting portion 57 of the connector body 50 to both axially and radially secure the post 40 in place.

In the meantime, the coupling nut 30 of the herein described coaxial connector 100 is secured to the post 40 and is mounted so as to permit free rotation, while the center conductor 18 extends through the first end 42 of the post 40 and outwardly from the coupling nut 30. More specifically and according to this prior art version, the coupling nut 30 is permitted limited axial movement through rotation thereof, wherein the nut flange 34 is caused to engage directly with the annular flange 44 of the post 40 as the coupling nut 30 is engaged with an external interface port 20.

External threads 23 of the external interface port 20 are then threadingly engaged with the internal threads 33 of the coupling nut 30 of the herein described connector 100, causing the coupling nut 30 to be secured thereupon through limited axial movement of the threaded nut as the lip 34 of the nut engages the flange 44 of the post 40. Electrical continuity is initiated based upon compressive contact that is created between the annular flange 44 of the post 40 and an end radial face of the interface port 20, when the coupling nut 30 has been fully tightened. As noted and though effective, the above coaxial cable connector 10 relies upon specific tolerance matchups between the external interface port 20 and the coupling nut 30 of the coaxial cable connector 100 in order to properly provide an effective connection therebetween. There is no permissible variability for this herein described coaxial cable connector 100, however, to accommodate various sized external interface ports.

With the preceding background and now referring to FIGS. 3-6, there is shown a compression-type coaxial cable connector made in accordance to the exemplary embodiment. The connector (herein labeled with the reference numeral 200) is an assemblage of components that include a connector body 220, a hollow post 240 and a coupling nut 260. Of significance and in contrast to the preceding, it should be noted that a separate compression sleeve or member is not required.

The connector body 220 according to this exemplary embodiment is made from a unitary one-piece construction from a plastic, such as Lexan or neoprene. The connector body 220 comprises a first end 222 and an opposing second end 223 wherein the body 220 is substantially hollow. More specifically, the connector body 220 is defined by a first body section 224 and an axially adjacent second body section 225. The first body section 224 is a substantially cylindrical portion that includes a post retaining portion 228 formed at the first end 222 wherein a center aperture 230 extends into a necked portion 231 having a first internal diameter. The necked portion 231 extends proximally toward the second end 223 of the connector body 220 and terminates at an annular shoulder 232 forming a wall of an interior passageway 233. The passageway 233 has a substantially constant second inner diameter that is larger than the first inner diameter of the necked portion 231. The outer or exterior diameter of the first body section 224 is further defined by an annular flange 229 having a first exterior diameter adjacent the first end 222 that is larger than a cylindrical axial section 234 having a second end substantially constant exterior diameter over substantially the remainder of the first body section 224. This latter axial section 234 is further defined by a relatively thin-walled construction as compared to, for example, that of the annular flange 229.

The second body section 225 is defined by a substantially cylindrical cross section, this body section having a substantially constant exterior outer diameter that is approximately equivalent to that of the annular flange 229 of the first body section 224. The distal end of the second body section 225 is joined to the proximal end of the thin-walled cylindrical axial portion 234 of the first body section 224, wherein a slight overlap is created therebetween.

Figure 5:
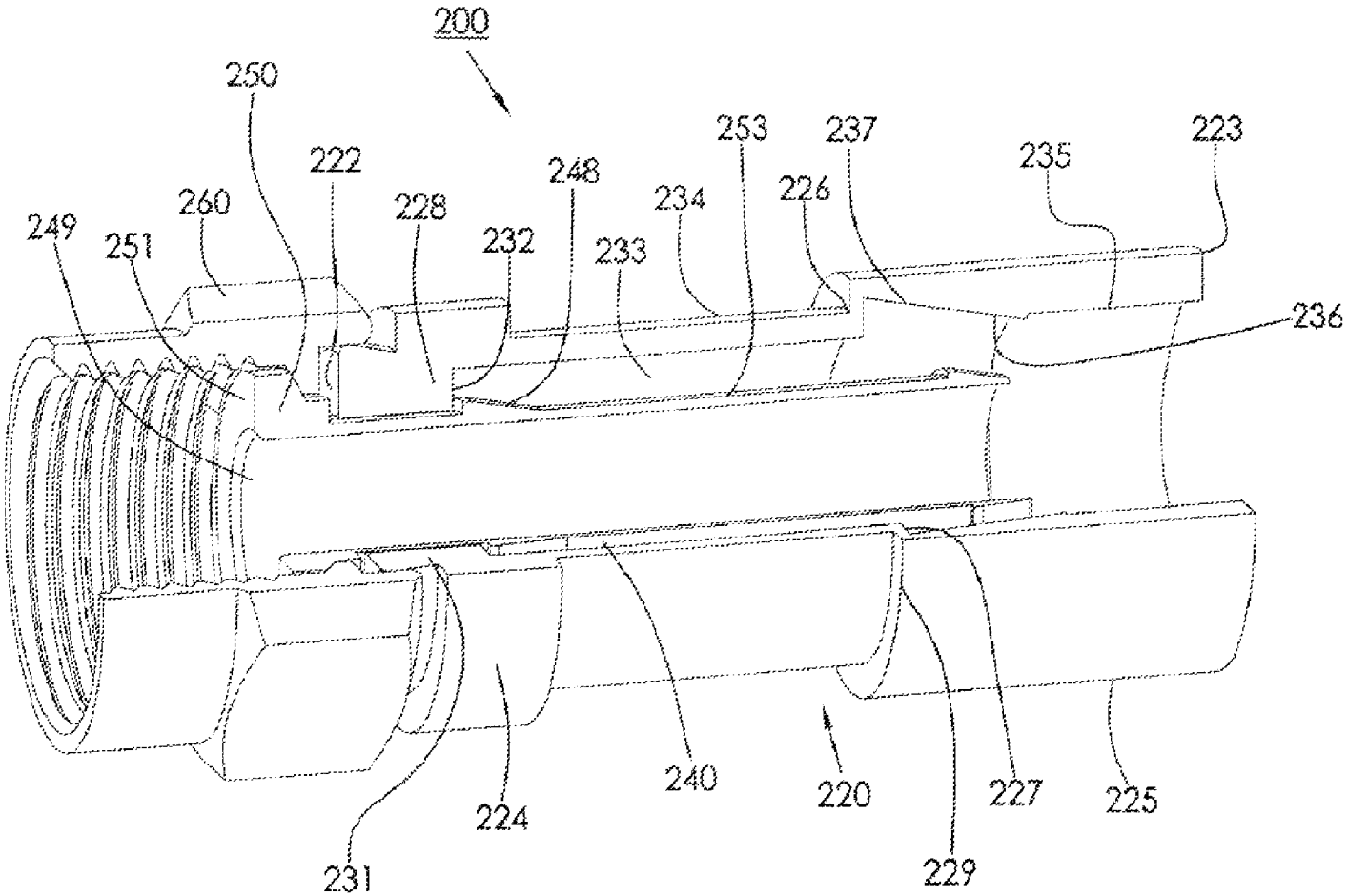
FIG. 5 is a sectioned view of the connector body of the coaxial cable connector of FIGS. 3 and 4 in a preassembled condition.

With further reference especially to FIG. 5, the second body section 225 is defined by a proximal diametrical portion 235 having a substantially constant first inner diameter adjacent the second end 223 of the connector body 220, a distal diametrical portion 237 having a second inner diameter adjacent the distal end 229 of the second body section 225 that is larger than the first inner diameter of the proximal diametrical section 235 and a transitional portion 236 extending therebetween having a ramped interior surface.

As noted, the proximal end 227 of first body section 224 and the distal end 229 of the second body section 225 are molded with a slight overlap, see FIG. 5, and are frangibly connected to one another by a weakened annular portion 226, forming a stress concentrator.

The hollow post 240 is defined by a first end 242 and an opposing second end 246. A substantial portion of the post 240 is sized to be fitted within the confines of the connector body 220 and retained axially and rotationally by the post retaining portion 228 that engages a surface feature 248, FIG. 5, of the post. The first end 242 is defined by a flange 250 having a center aperture 249 as well as a radial end edge 251. A shaft portion 253 of the post 240 is accommodated within the center passageway 233 of the connector body 220.

Figure 6:
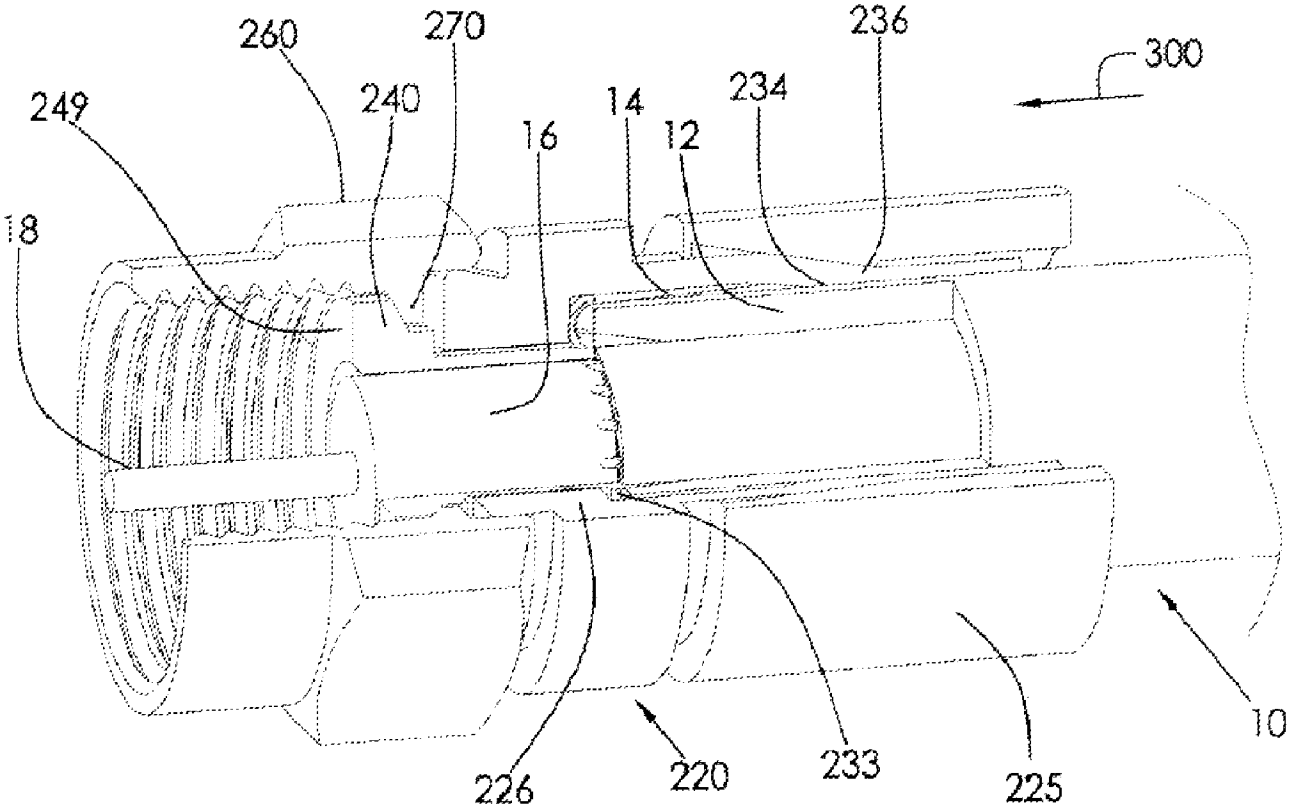
FIG. 6 is a sectioned view of the coaxial cable connector of FIGS. 3-5, as shown in an assembled condition.

The coupling nut 260 is defined by a first end 262 and an opposing second end 264, as well as a set of internal threads 266 within a center passageway 265. An interior lip or protrusion 270, shown most clearly in FIG. 6, is caused to engage a corresponding interior surface of the flange 250 of the post 240 when the nut is rotated to limit travel of the nut 260, which is freely rotatable. The nut 260 is attached for rotation about the first end 242 of the post 240 in which the first end is disposed within the center passageway 265 of the nut 260, similar to the preceding prior art connector embodiment, although other forms of connectivity can be provided.

The connector body 220 receives the post 240 onto which the coupling nut 260 is threadingly secured and freely rotatable to enable attachment to an interface port (not shown).

In operation, a coaxial cable end 10 as prepared in accordance with FIG. 1 is positioned within the second end 223 of the connector body 220 wherein the center conductor 18 and portions of the dielectric intermediate layer 16 are each disposed within the hollow confines of the post 240. A compressive axial force is then applied to the second body section 225 of the connector body 220 using a compression tool (not shown) or otherwise in a direction toward the first end 222. As this compressive axial force is applied, the weakened annular portion 226 is caused to fracture enabling the second body section 225 to break free from the first body section 224 and be shifted axially in the direction toward the first end 222 of the connector body 220 (i.e., toward the coupling nut 260), as shown in FIG. 6. The second body section 225 is therefore caused to move over the exterior surface of the cylindrical axial portion 234 as the distal diametrical portion 237 has an interior diameter which is larger than or equal to the exterior diameter of the cylindrical axial portion 234. As this axial movement progresses in the direction 300, FIG. 6, the transitional portion 236, including the ramped interior surface of the second body section 225, is caused to directly impinge upon the exterior of the thin walled cylindrical axial portion 234. Due to the relative size mismatch between the inner diameter of the proximal diametrical portion 235, which is smaller than the external diameter of the cylindrical axial section 234, that portion of the cylindrical axial portion 234 of the connector body 220 is caused to radially deform inwardly and therefore engage upon the shielding layer 14 and outer sleeve 12 of the prepared coaxial cable end 10 FIG. 6, effectively retaining same within the connector 200. The second body section 225 is therefore also effectively retained onto the exterior of the cylindrical axial section 234 of the connector body 220.

The mode of operation with regard to the movement of the fractured second body section 225 is therefore nearly identical to that of prior art compression type coaxial cable connectors, such as those described in FIGS. 1 and 2. However and according to this design, a separate component is not required in the overall connector assembly. The center conductor 18 is then caused to extend through the post 240 and outwardly from the coupling nut 260 in a manner commonly known. The coupling nut 260 can be used in relation to an appliance port (not shown) to threadingly engage the port to the connector 200.

PARTS LIST FOR FIGS. 1-6

10 cable end, coaxial
12 outer sleeve or jacket
14 shielding layer
16 dielectric layer, intermediate
18 center conductor
20 interface port
23 threads
30 threaded nut
31 first end
32 second end
33 threads
34 internal lip
40 post
41 first end
42 second end
43 hollow shaft portion
44 flange
45 annular shoulder
47 surface feature
50 connector body
51 first end
52 second end
53 deformable outer portion
55 outer surface, compliant
57 post mounting portion
58 outer annular recess
60 compression sleeve or member
61 first end
62 second end
65 center passageway
66 transitional section
67 first diametrical section
68 second diametrical section
80 connector body sealing member
100 connector, coaxial cable
200 connector, coaxial cable
220 connector body
222 first end
223 second end
224 first body section
225 second body section
226 weakened annular portion
227 proximal end, first body section
228 post retaining portion
229 distal end, second body section
230 center aperture
231 necked portion
232 annular flange
233 center passageway
234 cylindrical axial portion
235 proximal diametrical portion
236 transitional portion
237 distal diametrical portion
240 hollow post
242 first end
246 second end
248 surface feature
249 center aperture
250 flange
251 radial end edge
253 shaft portion
260 coupling nut
262 first end
264 second end
265 internal passageway
266 internal threads
300 direction It will be readily apparent that other variations and modifications are possible within the intended ambits of this application and as defined by the following claims.

The invention claimed is:

1. A single connector body for a coaxial cable connector, said single connector body comprising:

a hollow member having a first end and a second end;

a first body section, the first body section including a post mounting portion, at least a portion of said first body section being radially deformable; and an axially adjacent second body section frangibly connected to the first body section at a weakened annular portion, wherein an inner diameter of said second body section is tapered between a first inner diameter starting at the weakened annular portion and a second inner diameter which is smaller than an exterior diameter of said first body section;

wherein axial force applied upon said second end of said connector body towards said first body section causes said second body section to fracture relative to said first body section, said second body section being caused to move over an exterior surface of said first body section and form a compression sleeve.

2. A connector body as recited in claim 1, including said weakened annular portion between said first and second body sections that is caused to fracture when axial force is applied, thereby allowing said compression sleeve to move relative to a remainder of said connector body.

3. A connector body as recited in claim 1, wherein said connector body is formed from a moldable plastic material.

4. A connector body as recited in claim 1, wherein axial movement of said second body section causes radial compression of said first body section.

5. A coaxial cable connector comprising:

a coupling nut;

a hollow post having a first end and a second end, said second end being configured for engaging a coaxial cable end; and a single connector body being defined by a hollow member having opposing ends, said single connector body including a first body section and an axially adjacent second body section, wherein said second end of said hollow post is disposed within said first body section, at least a portion of said first body section being radially deformable;

an annular portion separating the first and second body sections, the annular portion caused to fracture when the axial force is applied;

wherein the second body section includes a tapered surface defined by a first inner diameter starting at the annular portion and a second inner diameter which is smaller than an exterior diameter of said first body section;

wherein compressive axial force applied upon said second end of said connector body causes said second body section to fracture relative to said first body section, said second body section being caused to move over an exterior surface of said first body section and form a compression sleeve.

6. A connector as recited in claim 5, wherein said second body section includes an interior axial portion tapering from the first inner diameter to the second smaller inner diameter such that movement of said second body section over the exterior surface of said first body section causes engagement of said tapering portion to create deformation thereof.

7. A connector as recited in claim 5, wherein said connector body is entirely formed from a moldable plastic.

8. A method for manufacturing a coaxial cable single connector body, said single connector body including a hollow member having a central bore and respective first and second ends, said method comprising:

integrally providing a first body section adjacent said first end and an axially adjacent second body section adjacent said second end in a single molded component, wherein the first body section includes a post mounting portion; and providing a frangible annular seam between said first body section and said second body section enabling said second body section to be detached from said first body section and to pass over an exterior of said first body section when said seam is broken under the application of an axial force;

wherein the second body section includes a tapered surface defined by a first inner diameter starting at the frangible annular seam and a second inner diameter which is smaller than an exterior diameter of said first body section.

* * * * *